United States Patent [19]

Salmi et al.

[11] 3,979,944

[45] Sept. 14, 1976

[54] HYDRAULIC DRILL, IN PARTICULAR A ROCK DRILL

[75] Inventors: Pekka Salmi; Rolf Strom, both of Tampere, Finland

[73] Assignee: Oy Tampella AB, Tampere, Finland

[22] Filed: Mar. 17, 1975

[21] Appl. No.: 558,805

[30] Foreign Application Priority Data

Mar. 18, 1974 Finland ..... 811/74

[52] U.S. Cl. ..... 173/8; 173/108

[51] Int. Cl.[2] ..... E21C 5/00

[58] Field of Search ..... 173/8, 9, 10, 19, 2, 173/12, 105, 108; 91/59; 175/24, 26, 122

[56] References Cited

UNITED STATES PATENTS

| | | | |
|---|---|---|---|
| 3,189,103 | 6/1965 | Attebo et al. | 173/8 |
| 3,381,761 | 5/1968 | Hansson | 173/19 |
| 3,409,089 | 11/1968 | Meyer | 173/9 |
| 3,669,197 | 6/1972 | Hanson et al. | 173/19 |
| 3,802,514 | 4/1974 | Ein et al. | 173/8 |

*Primary Examiner*—Ernest R. Purser
*Assistant Examiner*—Richard E. Favreau
*Attorney, Agent, or Firm*—Hauke & Patalidis

[57] ABSTRACT

A hydraulic rock drill having a hydraulic drill drive motor, a hydraulic feed motor, and a hydraulic impact unit and associated pumps for supplying hydraulic fluid under pressure and provided with an automatic control system including a valve controlling the flow to the impact unit under the dependence of the pressure in the rotation motor circuit such as to reduce the power of the impact unit when the pressure in the drive motor circuit exceeds a permissible pressure and vice versa. Additionally, the hydraulic system preferably includes an additional flow control valve such as to decrease the feed power when the impact power increases.

11 Claims, 1 Drawing Figure

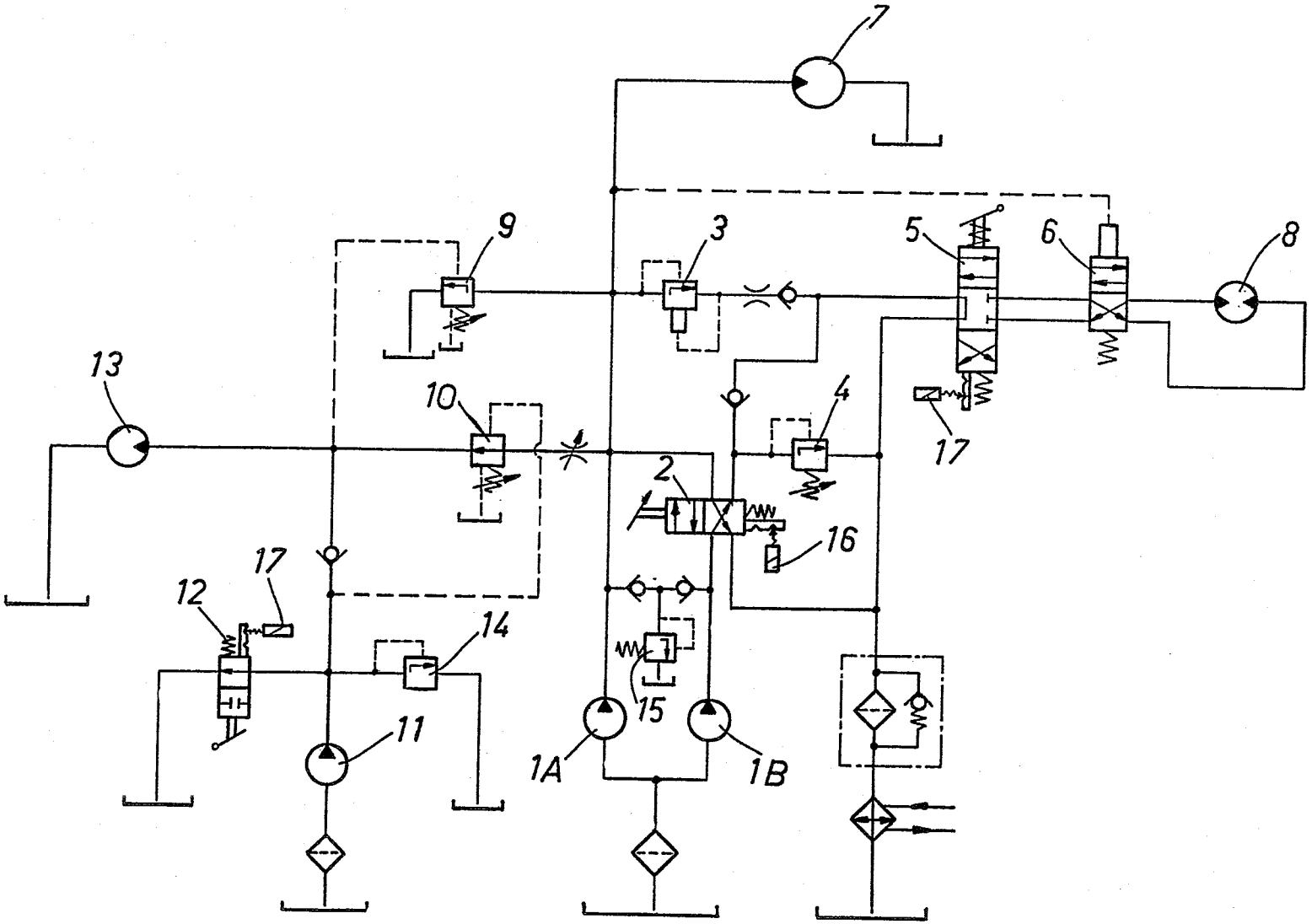
8
6
5
17
7
4
16
3
2
1B
15
1A
9
10
14
11
17
12
13

HYDRAULIC DRILL, IN PARTICULAR A ROCK DRILL

The present invention concerns a hydraulic drill, in particular a rock drill, comprising a partial circuit containing an impact machine, with pumps and valves; a partial circuit containing a rotation motor, with pump and valve; and a partial circuit containing a feed motor, with pump and valves.

The material to be drilled, such as rock, may be even highly inhomogeneous, whereby the drillrod penetrates it differently if a constant impact power and feed power are used. This may cause the drill hole to be plugged and the drilling operation to stop. It is therefore common practice that the drill operator observes the penetration of the drill rod and accordingly controls the impact and feed power, in which case the simultaneous management of several drill rigs becomes difficult.

From the French Patent No. 2,129,276, for instance, a hydraulic drill is known in which the impact unit has been connected in series with the drill rod rotating motor, whereby in the event of increase of the drill rod's resistance to rotation the pressure drop across the rotation motor reduces the power of the impact unit in order to prevent the drill rod from seizing. However, when the drilling operation is started, and when the material to be drilled is markedly inhomogeneous, this arrangement operates in a manner exactly opposite to what would be expedient. When the drill rod is rotating freely or in a soft material, the impact power is at its highest, although the impact power and feed power both should be low in order to introduce the drill rod into hard material with vernier feed.

The object of the present invention is to provide a hydraulic drill of the type mentioned and wherein the functions of all three hydraulic circuits, that is of that containing the impact machine, of that containing the rotation motor and of that containing the feed motor, have been made mutually dependent in an expedient manner so that the degree of automation of the drill increases and the drilling is facilitated so that one person is able to manage simultaneously several drill rigs.

In this connection automating is understood to mean the connecting together of the impact unit, the drill rod rotating motor and the drill rod feed device motor in such manner that the drill rod rotating motor in a manner of speaking serves as a sensing means and gives to the impact unit the command to operate with higher or lower power, as the case may be, and also governs the drill rod feed motor by mediation of the action of the impact unit so that when the impact power decreases the feed power also decreases.

According to an advantageous embodiment of the invention, when the impact power diminishes to be below a predetermined limit, the feed motor reverses its direction of rotation and a feed motion in the direction opposite to the preceding feed is initiated.

In the following the invention is described in more detail, with reference to the attached drawing which shows the hydraulic circuit diagram of a hydraulic drill according to the invention.

In the hydraulic diagram only those components have been depicted which most essentially influence the operation.

The circuit may be imagined subdivided into three parts, which are: the partial circuit containing the impact unit 7, the partial circuit containing the rotation motor 13, and the partial circuit containing the feed motor 8.

The task of the directional valve 2 is to direct the output from the pump 1B either to the partial circuit containing the feed motor 8, in which case the speed of rotation of the feed motor 8 is consistent with high speed traversing, or to the partial circuit containing the impact unit 7, in which case it mainly increases the volume flow at the disposal of the impact unit, while a minor portion of its supply goes to the feed motor 8. It is possible to decide by manual or electric control whether it is desired to use the high speed traversing mode, in which case there is no overpressure in the conduit to the impact unit 7, or whether it is desired to use the output of both pumps 1A and 1B to increase the volume flow in the partial circuit containing the impact unit 7. It is possible by means of a pulse from a hydraulic or electrical limit switch to switch the valve 2 to allow free circulation, whereby the output of both pumps 1A and 1B is directed into the tank.

The task of the directional valve 5 is to govern the volume flow arriving at the feed motor 8 so that the direction of rotation of the feed motor 8 can be manually or electrically controlled. It is possible by a manual or electric pulse to switch the valve to allow free circulation, whereby the flow arriving at the valve 5 is directed into the tank.

The task of the directional valve 12 is to govern when required, for instance at commencement of a drilling operation, the output of the pump 11 to choose the free circulation path. The valve 12 is operated by manual or electric control or by means of a hydraulic or electrical pulse. When the valve 12 is in the position in which the output of the pump 11 has been directed into the partial circuit containing the rotation motor 13, the purpose of the increased supply is to increase the speed of rotation of the rotation motor 13. In the normal drilling situation the valve 12 directs the pressure fluid from the pump 11 to the rotation motor 13.

The task of the pressure limiting valves 4, 14, 15 is to confine the pressure prevailing in each partial circuit containing such a pressure limiting valve, so that the designed maximum pressures will not be exceeded.

The task of the pressure ratio valve 3 is to conduct into the partial circuit containing the feed motor 8, such an amount of pressure fluid that the pressure in the said partial circuit remains all the time below a certain pressure level permitted for the feed motor, independent of the volume flow consumed by the feed motor 8. During normal drilling operations the task of the ratio valve 3 is to observe the pressure in the partial circuit containing the impact unit 7 and to change the pressure in the partial circuit containing the feed motor 8 in the same proportion so that when the pressure decreases in the partial circuit containing the impact unit 7, it will also decrease in the partial circuit containing the feed motor 8. In that case the consequence of a reduction of the impact power is a relief in feed power, and vice versa.

The task of the directional valve 6 is, when the pressure in the partial circuit containing the impact unit 7 falls below the set value, to switch the volume flow arriving at the rotation motor 8 so that the rotation motor 8 reverses its direction of rotation. The operation of the directional valve 6 is strictly associated with the operation of the flow control valve 9.

The task of the flow control valve 9 is, when the pressure in the partial circuit containing the rotation motor 13 rises above a fixed set point value, to conduct a part of the volume flow coursing in the partial circuit containing the impact device 7, into the tank and thereby to lower the pressure in said partial circuit. Hereby the impact of the impact unit 7 becomes lighter and at the same time in the partial circuit containing the feed motor 8, by action of the ratio valve 3, the pressure level decreases and the supply decreases. When the pressure falls below a certain limiting pressure, the directional valve 6 reverses the feed motor 8.

The task of the flow control valve 10 is, when the pressure in the partial circuit containing the rotation motor 13 falls below the pressure level corresponding to normal drilling, to conduct pressure fluid away from the partial circuit containing the impact unit 7 and thereby to lower the pressure in said circuit. The impact power of the impact unit 7 will then decrease and the feed power of the feed motor 8 will decrease. This action is of importance, above all, when a new hole is started, in which event the output of the pump 11 is directed to the free circulation path by means of valve 12.

When the feed motion has proceeded as far as the front limit, the limit switch 16 operates and directs the reversing valve 2 into the position in which it releases the pressure in the circuit containing the impact unit 7, whereby the directional valve 6 operates and reverses the feed power 8 to start the return feed, while at the same time the valve 2 switches the pressure fluid supply past the ratio valve 3 directly to the feed motor 8 for its rapid traversing motion.

When the feed has returned to the rear end position, the corresponding limit switch 17 operates and directs the valve 5 into its centre position, whereby the feed motor 8 stops, and the valve 12 into its free circulation position. The drill is then ready to start another drilling cycle.

It is easy to observe that the hydraulic drill described in the foregoing operates completely automatically after the drilling command has been given, without any risk of seizing or damage to the drill rod point when the drilling is started or cavities are pierced. In addition, it is possible to regulate non-linearly, as desired, the ratio of the rotation power and impact power.

We claim:

1. Hydraulic drill, in particular a rock drill, comprising a partial circuit containing an impact unit (7) with pumps (1A, 1B) and valves, a partial circuit containing a rotation motor (13) with pump and valve, and a partial circuit containing a feed motor (8) with pump and valves, characterized by a first valve (9) which derives its control from the partial circuit containing the rotation motor (13) in such manner that when the pressure in said partial circuit increases to exceed a given limit pressure the valve (9) begins to release flow from the partial circuit containing the impact unit (7) and to lower the pressure therein, whereby the power of the impact unit (7) decreases; and by a second valve (10) which derives its control from the partial circuit containing the rotation motor (13) in such manner that when the pressure in said partial circuit falls below a given limiting pressure the valve (10) begins to release flow from the partial circuit containing the impact unit (7) and to lower the pressure therein, whereby the power of the impact unit (7) decreases.

2. Drill according to claim 1 characterized by a directional valve (5) for electrically controlling the direction of rotation of the feed motor (8).

3. Drill according to claim 1, characterized by a valve (12), by means of which it is possible to electrically switch the output of the pump (11) of the feed motor (13) to free circulation.

4. Drill according to claim 1, characterized by a third valve (3) comprised in the partial circuit containing the feed motor (8) and which derives its control from the pressure variations in the partial circuit containing the impact unit (7) in such manner that when the impact power decreases the feed power decreases and when the impact power increases the feed power increases.

5. Drill according to claim 4, characterized in that a pressure ratio valve is connected between the partial circuit containing the rotation motor (8) and the partial circuit containing the impact unit (7), said pressure ratio valve controlling the flow going to the feed motor (8) and being governed by the pressure variations occurring in the partial circuit containing the impact unit (7).

6. Drill according to claim 1, characterized by a directional valve (6) comprised in the partial circuit containing the feed motor (8) and which derives its control from the partial circuit containing the impact unit (7) in such manner that when the pressure in said partial circuit falls below a given limiting pressure flow through the feed motor (8) is reversed, whereby the feed direction is reversed.

7. Drill according to claim 5, characterized in that it comprises a limit switch (16) and the reversing valve (2) comprised in the circuit containing the impact unit (7) is arranged to be governed by said limit switch (16) determining the front limit of feed in such manner that while the valve (2) switches the pressure fluid to bypass the ratio valve (3) and to go directly to the feed motor (8), it simultaneously releases the pressure from the circuit containing the impact unit (7), whereby the directional valve (6) operates and actuates the return feed.

8. Drill according to claim 1, characterized by a directional valve (5) for manually controlling the direction of rotation of the feed motor (8).

9. Drill according to claim 8, characterized in that the directional valve (5) can be switched to allow free circulation under control by a limit switch (17) determining the rear feed limit.

10. Drill according to claim 1, characterized by a valve (12), by means of which it is possible to manually switch the output of the pump (11) of the rotation motor (13) to free circulation.

11. Drill according to claim 10, characterized in the valve (12) switched to allow free circulation is controlled by a limit switch (17) determining the rear feed limit.

* * * * *